US006082162A

United States Patent [19]

Muschalik et al.

[11] Patent Number: 6,082,162

[45] Date of Patent: Jul. 4, 2000

[54] MULTIPLE-CYLINDER EXTRUSION PRESS

[75] Inventors: Uwe Muschalik, Duisburg; Karl Hermann Claasen, Moers, both of Germany

[73] Assignee: SMS Eumuco GmbH, Leverkusen, Germany

[21] Appl. No.: 09/401,582

[22] Filed: Sep. 22, 1999

[51] Int. Cl.[7] ..... B21C 23/00

[52] U.S. Cl. ..... 72/253.1; 72/273.5

[58] Field of Search ..... 72/253.1, 273.5; 92/6 R, 110, 162 R, 165 R; 100/226, 269.18

[56] References Cited

U.S. PATENT DOCUMENTS

| | | | |
|---|---|---|---|
| 3,311,030 | 3/1967 | Halstead . | |
| 3,649,816 | 3/1972 | Johnes et al. | 72/253.1 |
| 3,786,725 | 1/1974 | Aoki . | |
| 3,818,801 | 6/1974 | Kime . | |
| 4,379,398 | 4/1983 | Asari et al. | 72/253.1 |
| 4,944,215 | 7/1990 | Nimmo . | |
| 4,961,372 | 10/1990 | Leonhartsberger | 92/108 |
| 4,981,426 | 1/1991 | Katashi | 425/150 |
| 5,062,285 | 11/1991 | Groos | 72/253.1 |

FOREIGN PATENT DOCUMENTS

| | | | |
|---|---|---|---|
| 0 822 017 | 2/1998 | European Pat. Off. | 1/1 |
| 510 895 | 9/1930 | Germany | 1/1 |

OTHER PUBLICATIONS

Fluidtechnik–Hydraulik "Einbaumasse Fur 2–Wege–Einbauventile", Beiblatt 1 zu DIN 24342, Sep.1985, 8 pages.

*Primary Examiner*—Ed Tolan

*Attorney, Agent, or Firm*—Herbert Dubno; Andrew Wilford

[57] ABSTRACT

An extruding press has a housing defining an axis, an end frame displaceable axially on the housing, and a plurality of cylinders on the housing. Respective pistons having axially oppositely directed front and rear faces subdivide the cylinders into front and rear compartments and respective piston rods extend from the pistons axially forward through the respective rear compartments out of the respective cylinders and are connected to the end frame. A tool is fixed on the housing so that a workpiece positioned between the tool and the end frame can be extruded through the tool when the front compartments are pressurized to axially rearwardly displace the end frame and press the workpiece rearward against the tool. Respective fluid-powered actuators braced between the housing and the pistons can be pressurized to displace the end frame forward away from the tool. Passages extending between the compartments and controllable valves in the passages permit free fluid flow between the compartments. Respective filler bodies projecting rearward from the rear faces through the respective front compartments out of the respective cylinders each reduce an effective surface area of the respective rear face so that it is generally equal to an effective surface area of the front face of the respective piston. Respective elements engaging the filler bodies permit same to move radially relative to the respective piston.

12 Claims, 5 Drawing Sheets

MULTIPLE-CYLINDER EXTRUSION PRESS

FIELD OF THE INVENTION

The present invention relates to an extrusion press. More particularly this invention concerns a multiple-cylinder extrusion press.

BACKGROUND OF INVENTION

A standard extruding press has a housing defining an axis, an end frame displaceable axially on the housing, and a plurality of cylinders on the housing each having a piston having a piston rod connected to the end frame. Each piston subdivides the respective cylinder into front and rear compartments. A tool is fixed on the housing and a workpiece can be positioned between the tool and the end frame which can carry another tool. When the front compartments are pressurized the workpiece is pressed rearward against the tool can be extruded through it. The use of plural cylinders (as described in *Hydraulische Pressen und druckflüssigkeitsanlagen* by Ernst Müller, volume 3, pages 83 and 84 and German patent 510,895) eliminates the need for a separate guide frame on the press.

Separate respective fluid-powered actuators are braced between the housing and the pistons so that when pressurized they displace the end frame forward away from the tool at a considerably higher speed than the speed of the end frame when it is forcing the workpiece through the frame-mounted tool. To make this possible there are passages extending between the compartments and controllable valves in the passages for permitting free fluid flow between the compartments during this fast forward movement.

Thus it is standard to provide auxiliary fluid actuators that can rapidly open the press and bring it to the initial closed position at the start of a pressing cycle. The problem with this is that substantial volumes of hydraulic fluid must be moved into and out of the two compartments of the heavy-duty double-acting ram that is used for this type of machine. As a result of the high-volume flow, there is turbulence and air bubbles can be entrained or sucked into the fluid, compromising operation of the machine.

Accordingly EP 0,822,017 proposes a system where the actuator has a piston with a pair of oppositely directed piston rods projecting axially out of opposite ends of the cylinders. Shunt conduits are provided between opposite ends of the cylinders with valves that can be opened so when the pistons are quick-stroked to their open positions fluid can flow through the shunt between the compartments. The function of the front piston rod is to reduce the effective surface area of the rear piston face, that is the area exposed axially in the rear compartment, so that is it generally equal to that of the front piston face, so that although there is some flow between compartments, the total volume of the compartments does not change significantly as the piston moves.

The problem with such a system is that there are several potential leak points that serve little function. Where the rear piston rod projects through the rear end of the cylinder must be meticulously sealed. This problem is complicated by the fact that the piston rods are exerting enormous forces and are subject to some bending. As a result the rear piston rod can jam in the rear cylinder wall or at least subject one side of the seal to considerable wear if the piston gets slightly canted.

OBJECTS OF THE INVENTION

It is therefore an object of the present invention to provide an improved multicylinder extrusion press.

Another object is the provision of such an improved multicylinder extrusion press which overcomes the above-given disadvantages, that is which can be rapidly cycled without the difficulties of the prior-art presses.

SUMMARY OF THE INVENTION

An extruding press has according to the invention a housing defining an axis, an end frame displaceable axially on the housing, and a plurality of cylinders on the housing. Respective pistons having axially oppositely directed front and rear faces that subdivide the cylinders into front and rear compartments and respective piston rods extend from the pistons axially forward through the respective rear compartments out of the respective cylinders and are connected to the end frame. A tool is fixed on the housing so that a workpiece positioned between the tool and the end frame can be extruded through the tool when the front compartments are pressurized to axially rearwardly displace the end frame and press the workpiece rearward against the tool. Respective fluid-powered actuators braced between the housing and the pistons can be pressurized to displace the end frame forward away from the tool. Passages extending between the compartments and controllable valves in the passages permit free fluid flow between the compartments. Respective filler bodies projecting rearward from the rear faces through the respective front compartments out of the respective cylinders each reduce an effective surface area of the respective rear face so that it is generally equal to an effective surface area of the front face of the respective piston. Respective elements engaging the filler bodies permit same to move radially relative to the respective piston.

With this system, therefore, virtually all of the flow when fast-stroking the piston will be through the passages, so that turbulence and cavitation can be minimized. At the same time the movable filler body will not jam, but instead will serve purely to reduce the effective surface area of the rear piston face.

According to the invention the filler bodies are each formed by a respective plurality of telescoping sleeves a front one of which is secured to the respective piston and a rear one of which is secured to the respective cylinder. Thus there is no problem sealing between the filler body and the cylinder and the joints between adjacent sleeves permits the piston to cant without jamming.

The piston in accordance with the invention can have an axially rearwardly projecting extension over which the respective front sleeve is secured. More particularly each cylinder has a rear end formed with a cap forming a forwardly open cavity in which the respective filler body and extension are received in a rear end position thereof.

Each cylinder is provided with a sump connection opening into an interior of the respective cylinder body and with a sump connection opening into the respective front compartment. Thus any leakage into the filler body can be conducted off and any minor differences in volume as the piston moves can be compensated out.

The cylinder according to the invention has a rear end wall and is provided with a plunger piston extending axially forward therefrom and axially slidable in and forming a chamber the respective piston so that pressurization of the chambers displaces the pistons forward. The plungers are each formed with a respective axially throughgoing passage through which the respective chambers can be pressurized. In addition the pistons are formed with passages connecting the chamber with the valves and the valves open when pressurized via the respective passages. Thus when the plunger-piston passage is pressurized, this automatically opens the valves to allow the piston to fast-stroke to the front end position and allow the press to be reloaded.

The elements engaging the filler bodies can be swivel joints. Alternately the cylinders have rear end walls through which the respective filler bodies project and the elements engaging the filler bodies are rings set in the rear end walls, sealingly engageable around the respective filler bodies, and radially displaceable in the respective end walls.

In another system according to the invention respective axially movable partitions in the front compartments form therein a front subcompartment and means is provided for pressurizing the front subcompartment with a gas. Thus the overall volume of the two compartments will remain the same.

BRIEF DESCRIPTION OF THE DRAWING

The above and other objects, features, and advantages will become more readily apparent from the following description, it being understood that any feature described with reference to one embodiment of the invention can be used where possible with any other embodiment and that reference numerals or letters not specifically mentioned with reference to one figure but identical to those of another refer to structure that is functionally if not structurally identical. In the accompanying drawing.

SPECIFIC DESCRIPTION

Figure 1:
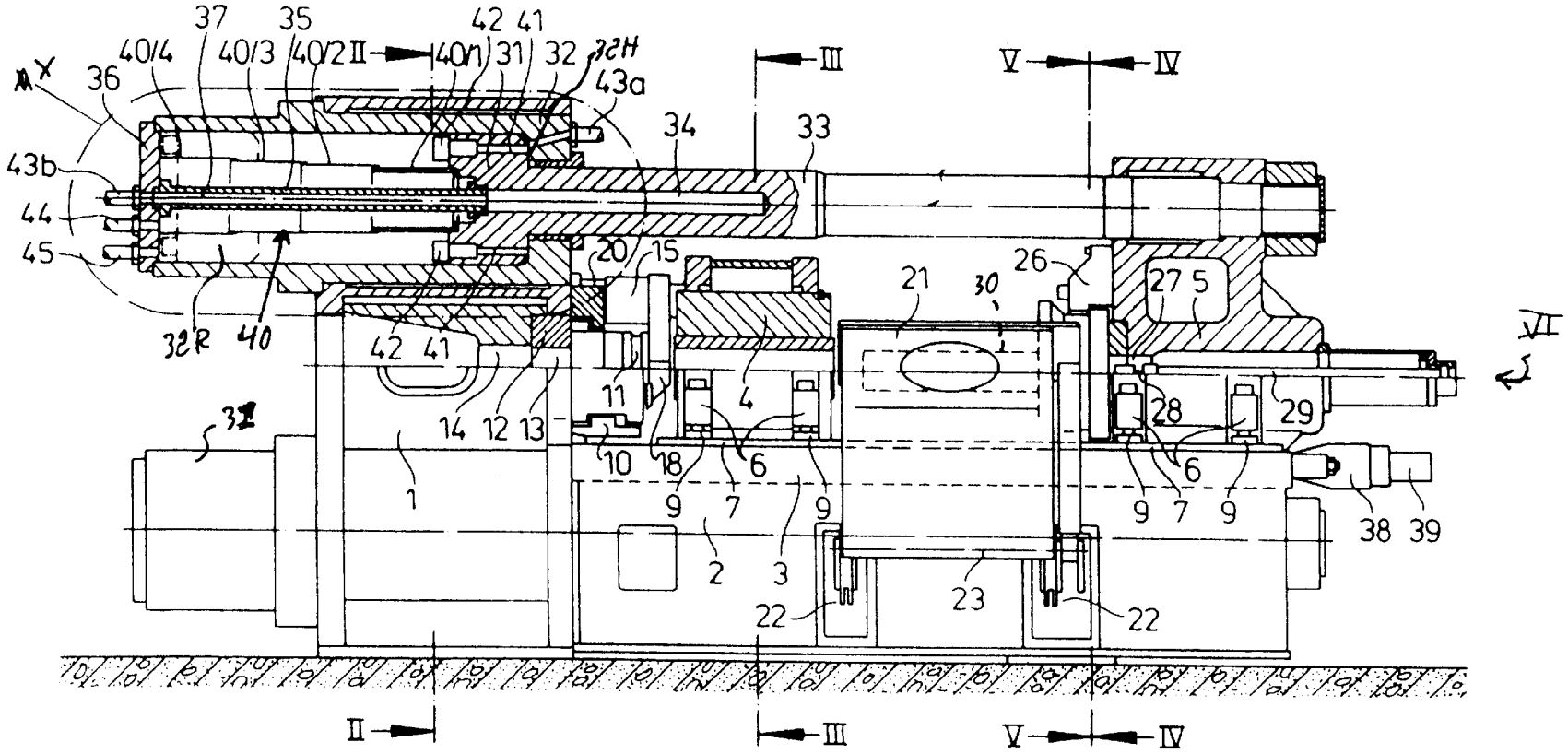
FIG. 1 is an axial section through the press according to the invention.
Figure 2:
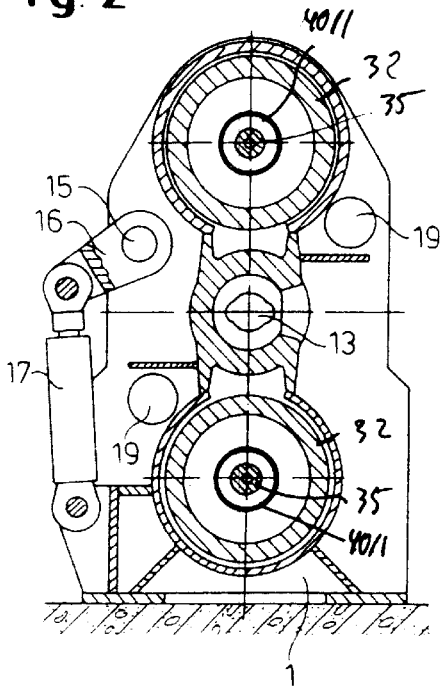
FIGS. 2, 3, 4, and 5 are sections taken along respective lines II—II, III—III, IV—IV, and V—V of FIG. 1.
Figure 3:
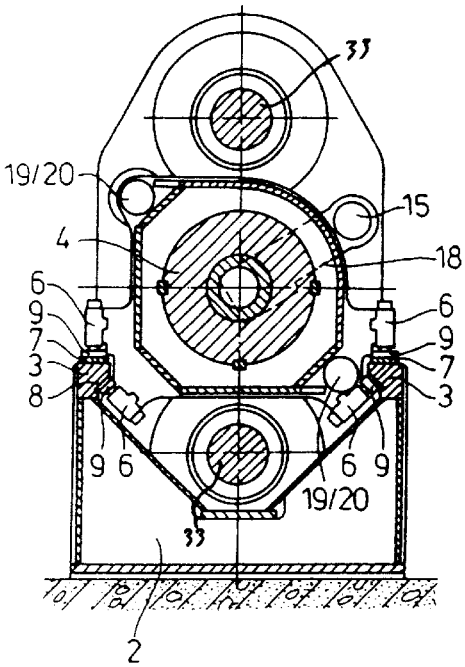

As seen in FIGS. 1 to 6 an extrusion press has a cylinder housing 1 fixed on a base frame 2 that is provided with horizontal guide rails 3 on which are supported a block holder 4 and an end frame 5. Adjusters 6 engage slide plates 7 and 8 on the rails 3, in part via slide shoes 9, and serve to accurately center the block holder 4 and end frame 5 on a longitudinal center axis A of the machine.

The housing 1 has a tool guide 10 carrying a replaceable tool 11, here a sleeve die. A tool-support plate 12 is formed with a cutout 13 and the housing 1 has a passage 14 for receiving a workpiece extruded through the tool 11. A shaft 15 extending parallel to the axis A is pivoted about its axis by an arm 16 via a hydraulic actuator or ram 17 so it can swing a blade 18 across the front end face of the tool 11 to shear off a front end of any workpiece engaged in it. Further hydraulic actuators or rams 19 on the housing 1 have piston rods 20 serving to axially shift the block holder 4 and press it against the front face of the tool 11.

Figure 4:
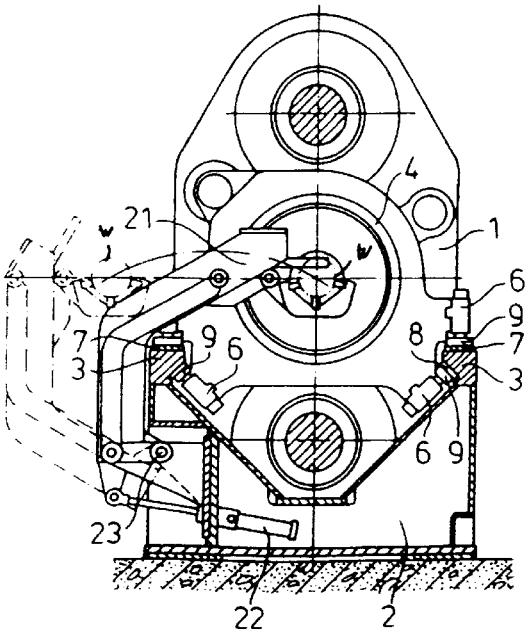
Figure 5:
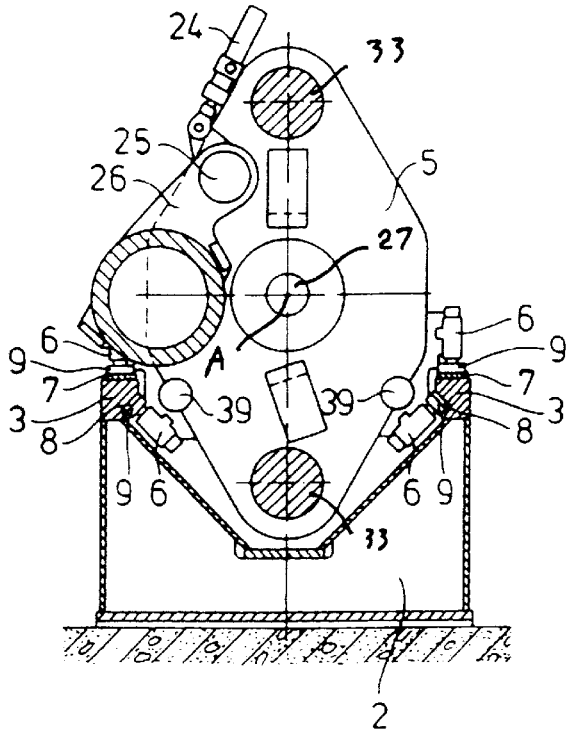
Figure 6:
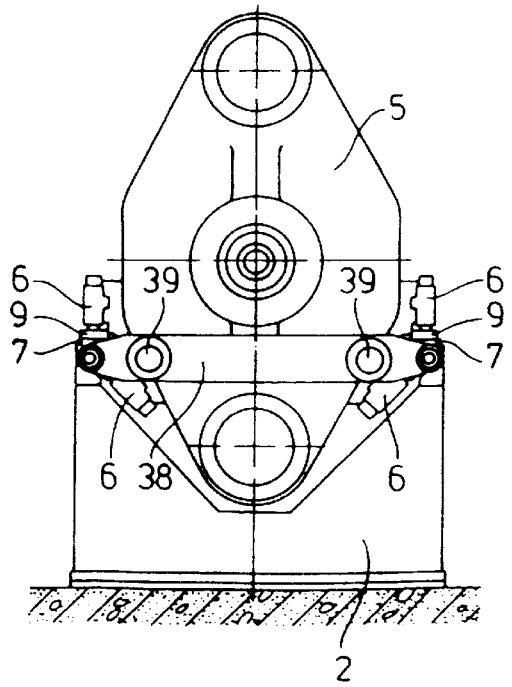
FIG. 6 is an end view taken in the direction of arrow VI of FIG. 1.

A block or workpiece loader 29 is displaceable by actuators 22 about an axis 23 parallel to the axis A from a front position shown in dot-dash lines in FIG. 4 to a rear position when there is sufficient space between the block holder 4 and the end frame 5. Another actuator 24 pivots a support arm 26 about an axis 25 parallel to the axis A and between the outside position of FIG. 5 in which it leaves the space between the frame 5 and holder 4 clear for loading of a fresh workpiece W by the loader 21, and an inside position covering a hole 27 in the frame 5. When this hole 27 is uncovered a piston rod 28 of a further actuator 29 can push a workpiece W along the axis 21 from the loader 21 into the bore of the holder 4. Once the block is set in the holder 4, the piston 28 is withdrawn, then the loader 21 is swung out, the actuators 19 pull the holder 4 against the die tool 11, and the arm 26 is swung in so that a die 30 on the arm 26 can be brought to bear on the front end of the workpiece W in the holder 4 to press the rear end of the workpiece W against a front face of the die 11.

Large pistons 31 in cylinders 32 vertically symmetrically flanking the axis A have piston rods 33 extending parallel to the axis A and fixed in the end frame 5. These pistons 31 each subdivide the interior of the respective cylinder 32 into rear and front compartments 32R and 32H. Pressurization of the front compartments 32H moves the pistons 31 rearward, that is to the left in FIG. 1, and force the die 30 against the outside face of the workpiece W so as to drive it through the die 12 and into the passage 14.

A small-diameter plunger piston 35 fixed in an end plate 36 of each of the cylinders 32 has a central axially throughgoing passage and is slidable in a cylinder-forming bore 34 in the respective piston 31 and rod 33. Thus pressurization of the passage 37 and bore 34 will move the pistons 31 forward, to the right in FIG. 1, to open up the press at the end of the cycle so the loader 21 can supply a new workpiece W, and so the block 4 can be retracted by the cylinders 10 to allow the blade 19 to cut off the front end of the workpiece W. Further actuators 39 engaging a bridge on the frame 2 can help retract the frame 5 to its front position.

The speed with which the press is opened should be much faster than the very slow speed with which it closes during its working cycle so as to minimize cycling time. In order to let each piston 31 move as rapidly as possible the respective compartment 32R is provided with a filler body 40 constituted as four telescoping sleeves 40/1, 40/2, 40/3, and 40/4. The sleeve 40/1 is fixed to the rear face of the piston 31 and the sleeve 40/4 to the cylinder end wall 36 and the body 40 has generally the same diameter as the respective piston rod 33. The fit of the sleeves 40/1 to 40/4 with each other is loose enough that the piston 31 can cant slightly in the cylinder 32 without binding. Thus the effective surface area of the rear face of the piston 31 exposed in the compartment 32H is substantially the same as the effective surface area of the front piston face exposed in the compartment 32R. As a result the total amount of liquid held in the cylinder 32 will be substantially the same, regardless of the axial position of the piston.

The piston 31 itself is formed with a plurality of axially throughgoing passages or holes 41 each provided with a two-way valve 42 of the type described in DIN 24,342. These valves 42 are opened during the return cycle of the machine, that is when the piston is moving from left to right, to allow the fluid in the compartment 32H to flow into the compartment 32R. Inlet conduits 43*a* and 43*b* are respectively pressurized to move the pistons 31 rearward and forward. A conduit 44 connected to an unillustrated sump allows liquid to flow out of and into the interior of the filler body 40. Another sump conduit 45 is connected to the compartment 32R and allows some fluid to exit and enter this compartment to compensate for minor changes in the total volume of the two compartments 32H and 32R.

Figure 7:
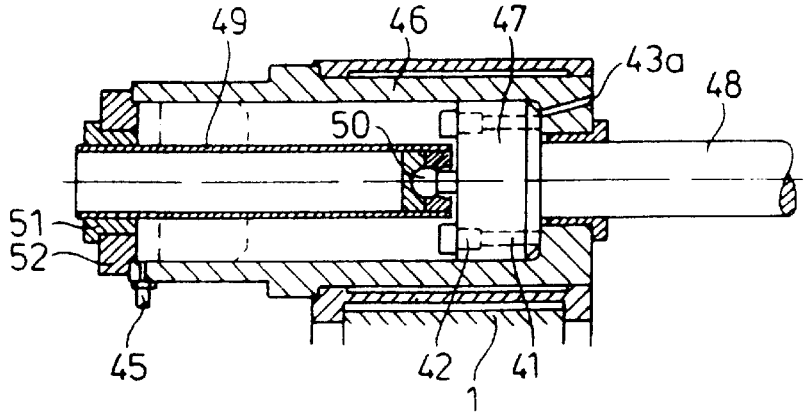
FIGS. 7, 8, 9, and 10 are partly schematic views of alternatives to the structure indicated at X in FIG. 1.

The arrangement of FIG. 7 has a cylinder 46 holding a piston 47 with a piston rod 48. A cylindrical filler body formed as a sleeve 49 is coupled via a ball joint 50 to the rear face of the piston 47 and is a snug fit in a seal ring 51 set in an end plate of the cylinder 46. Thus any misalignment of the axes of the cylinder 46 and the piston rod 48 can be compensated for by the swivel joint 50.

Figure 8:
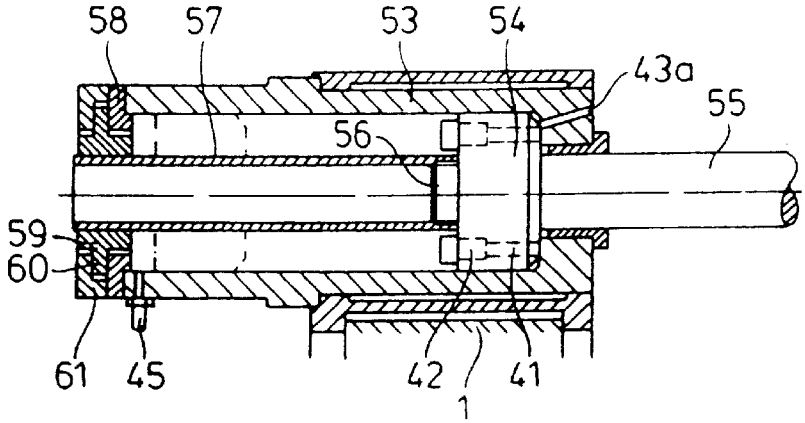

In FIG. 8 a cylinder 53 has a piston 54 with a piston rod 55. A threaded stud 56 on the rear face of the piston 54 is screwed into the front end of a filler-body sleeve 57 whose front end slides in a ring 59 having a radially projecting periphery 60 received with radial play in a radially inwardly open groove 60 formed by a ring 61 in an end plate 58 of the cylinder 53. Thus radial movement of the ring 59 compensates for misalignment of the piston 54 in the cylinder 53.

Figure 9:
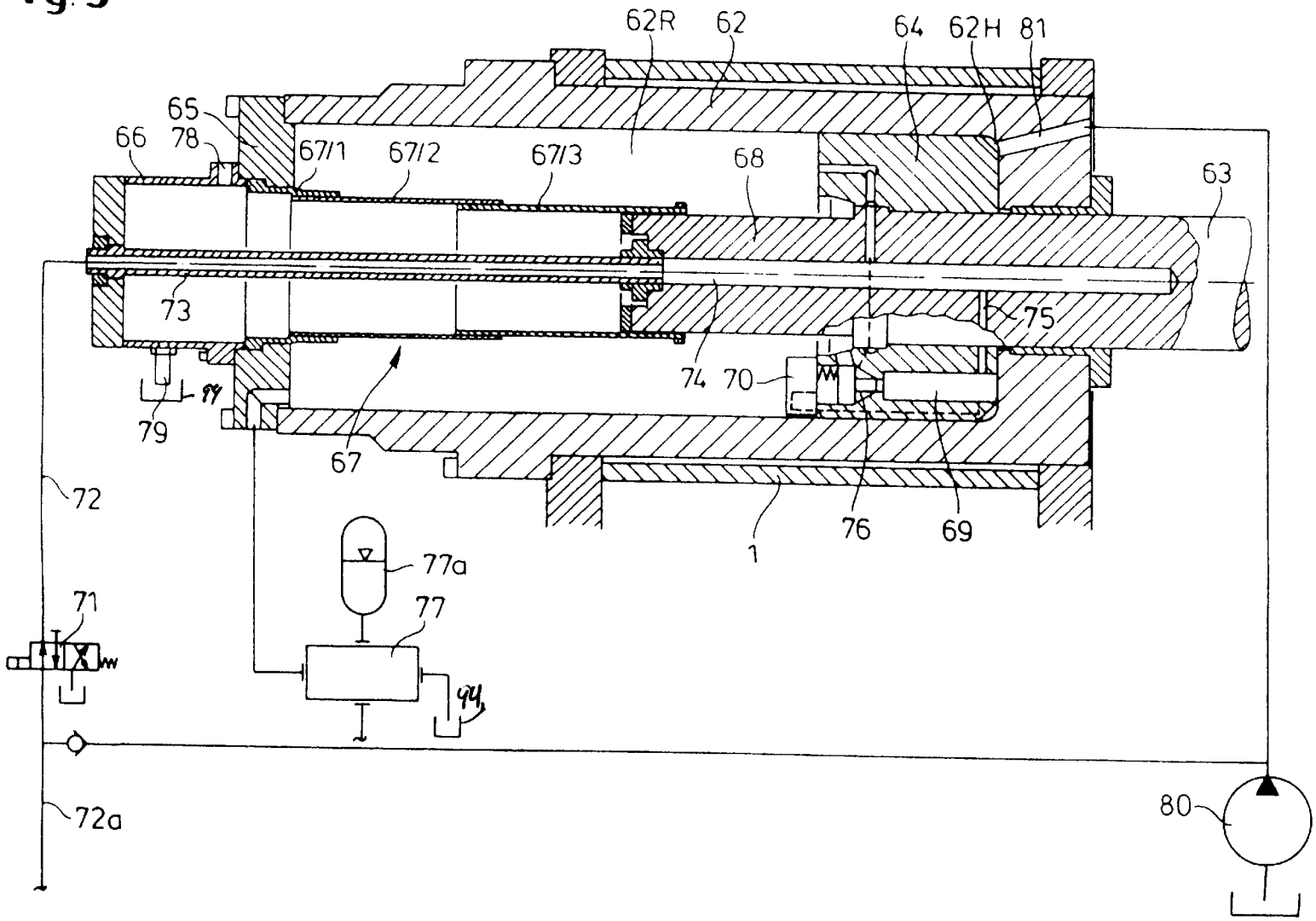

The system shown in FIG. 9 has cylinder 62 subdivided by a piston 64 having a piston rod 63 into a pair of compartments 62H and 62R. The cylinder 62 has a rear end plate 65 provided with a cap-like extension 66 forming part of a filler body 67 constituted as three telescoping sleeves 67/1, 67/2, and 67/3 the latter of which fits over a rearwardly projecting stud 68 formed on the piston 64 which is formed with axially throughgoing passages 69 having respective valves 70. As in FIGS. 1 to 6, here the filler body is wholly contained in the rear compartment to minimize sealing problems.

A pilot valve 71 is connected via a line 72 to a passage of a plunger piston 73 fixed in the extension 66 and projecting into a central bore 74 of the piston 64. Radial passages 75 conduct fluid from this passage 74 to rear compartments 76 of the valves 70 to open them when pressurized.

A fluid controller 77 connected between a buffer 77*a* and a sump 94 can pressurize the compartment 62R for fast opening of the extruder. The interior of the filler 67 opens via a fitting 79 into the sump 94 and a pump 80 supplies pressure to the pilot valve 71 and a fill port 81. The valves 70 are opened for free flow between the compartments 62H and 62R during opening of the press.

Figure 10:
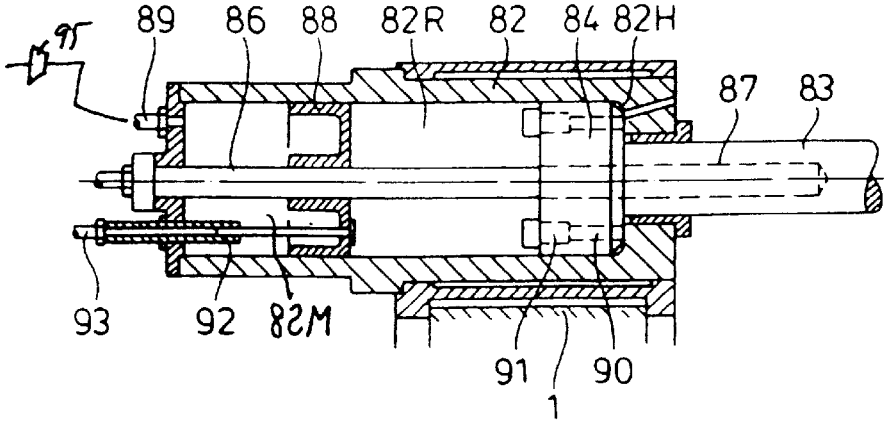

Finally, FIG. 10 shows an alternative arrangement wherein a cylinder 82 is subdivided by a piston 84 having a piston rod 83 into a pair of compartments 82H and 82R. A cover 85 at one end of the cylinder 82 carries a plunger piston 86 that extends in a bore 87 of the piston 84. A partition piston 88 is axially slidable on the piston 865 in the compartment 824 and the compartment 82M at its front face is pressurized with air from a compressor 95 through an inlet conduit 89 with a pressure to set it at such a position that the volume of oil in the two compartments 82H and 82R does not change significantly. Holes 90 in the piston 84 are provided with controllable valves 91 and extra liquid forced out of the compartment 82R can pass through telescoping tubes 92 to a sump line 93. The partition piston 88 moves through a stroke 88 on opening of the machine that is inversely proportional to the stroke of the piston 84 by the ratio of the two effective surface areas the piston 84 exposed in the compartments 82H and 82R.

We claim:

1. An extruding press comprising:

a housing defining an axis;

an end frame displaceable axially on the housing;

a plurality of cylinders on the housing;

respective pistons having axially oppositely directed front and rear faces and subdividing the cylinders into front and rear compartments;

respective piston rods extending from the pistons axially forward through the respective rear compartments out of the respective cylinders and connected to the end frame;

a tool fixed on the housing;

means for positioning a workpiece between the tool and the end frame;

means for pressurizing the front compartments and thereby axially rearwardly displacing the end frame and pressing the workpiece rearward against the tool;

respective fluid-powered actuators braced between the housing and the pistons;

means for pressurizing the actuators and thereby displacing the end frame forward away from the tool;

means including passages extending between the compartments and controllable valves in the passages for permitting free fluid flow between the compartments;

respective filler bodies projecting rearward from the rear faces through the respective front compartments out of the respective cylinders and each reducing an effective surface area of the respective rear face so that it is generally equal to an effective surface area of the front face of the respective piston; and means including respective elements engaging the filler bodies for permitting same to move radially relative to the respective piston.

2. The extruding press defined in claim 1 wherein the filler bodies are each formed by a respective plurality of telescoping sleeves a front one of which is secured to the respective piston and a rear one of which is secured to the respective cylinder.

3. The extruding press defined in claim 2 wherein the piston has an axially rearwardly projecting extension over which the respective front sleeve is secured.

4. The extruding press defined in claim 3 wherein each cylinder has a rear end formed with a cap forming a forwardly open cavity in which the respective filler body and extension are received in a rear end position thereof.

5. The extruding press defined in claim 2 wherein each cylinder is provided with a sump connection opening into an interior of the respective cylinder body.

6. The extruding press defined in claim 2 wherein cylinder has a rear end wall and is provided with a plunger piston extending axially forward therefrom and axially slidable in and forming a chamber the respective piston, whereby pressurization of the chambers displaces the pistons forward.

7. The extruding press defined in claim 6 wherein the plungers are each formed with a respective axially throughgoing passage through which the respective chambers can be pressurized.

8. The extruding press defined in claim 6 wherein the pistons are formed with passages connecting the chamber with the valves and the valves open when pressurized via the respective passages.

9. The extruding press defined in claim 1 wherein the elements engaging the filler bodies are swivel joints.

10. The extruding press defined in claim 1 wherein the cylinders have rear end walls through which the respective filler bodies project and the elements engaging the filler bodies are rings set in the rear end walls, sealingly engageable around the respective filler bodies, and radially displaceable in the respective end walls.

11. The extruding press defined in claim 1 wherein each cylinder is provided with a sump connection opening into the respective front compartment.

12. An extruding press comprising:

a housing defining an axis;

an end frame displaceable axially on the housing;

a plurality of cylinders on the housing;

respective pistons having axially oppositely directed front and rear faces and subdividing the cylinders into front and rear compartments;

respective piston rods extending from the pistons axially forward through the respective rear compartments out of the respective cylinders and connected to the end frame;

a tool fixed on the housing;

means for positioning a workpiece between the tool and the end frame;

means for pressurizing the front compartments and thereby axially rearwardly displacing the end frame and pressing the workpiece rearward against the tool;

respective fluid-powered actuators braced between the housing and the pistons;

means for pressurizing the actuators and thereby displacing the end frame forward away from the tool;

means including passages extending between the compartments and controllable valves in the passages for permitting free fluid flow between the compartments;

respective filler bodies projecting rearward from the rear faces through the respective front compartments out of the respective cylinders and each reducing an effective surface area of the respective rear face so that it is generally equal to an effective surface area of the front face of the respective piston;

respective axially movable partitions in the front compartments forming therein a front subcompartment; and means for pressurizing the front subcompartment with a gas.

* * * * *